US005241833A

United States Patent [19]

Ohkoshi

[11] Patent Number: 5,241,833

[45] Date of Patent: Sep. 7, 1993

[54] AIR CONDITIONING APPARATUS

[75] Inventor: Seizi Ohkoshi, Shizuoka, Japan

[73] Assignee: Kabushiki Kaisha Toshiba, Kawasaki, Japan

[21] Appl. No.: 903,597

[22] Filed: Jun. 24, 1992

[30] Foreign Application Priority Data

Jun. 28, 1991 [JP] Japan ..... 3-157280

[51] Int. Cl.[5] ..... F25B 49/02

[52] U.S. Cl. ..... 62/126; 62/129; 62/204; 62/211; 62/222

[58] Field of Search ..... 62/126, 127, 129, 209, 62/222, 223, 224, 225, 210, 211, 212, 204

[56] References Cited

U.S. PATENT DOCUMENTS

| | | | |
|---|---|---|---|
| 4,220,010 | 9/1980 | Mueller et al. | 62/209 X |
| 5,009,074 | 4/1991 | Goubeaux et al. | 62/129 X |
| 5,009,076 | 4/1991 | Winslow | 62/129 |
| 5,044,168 | 9/1991 | Wycoff | 62/129 X |

FOREIGN PATENT DOCUMENTS 60-194259 10/1985 Japan .

2227577A 8/1990 United Kingdom .

*Primary Examiner*—Harry B. Tanner

*Attorney, Agent, or Firm*—Limbach & Limbach

[57] ABSTRACT

A refrigerating circuit of an air conditioning apparatus has a refrigerating circuit which is formed with a compressor, an expansion valve, a first heat-exchanger and a second heat-exchanger. The amount of the refrigerant in the refrigerating circuit is controlled by the expansion valve which is controlled by a control unit. The control unit is provided with detector means including various sensors for detecting the ambient temperature, saturation temperature of the refrigerant in the refrigerating cycle, temperature of the discharged refrigerant fed from the compressor, etc. Detection of refrigerant leakage from the refrigerating circuit is accurately performed by the detector means. Control means responsive to the detector means controls the operation of the compressor. The compressor is stopped when the ambient temperature is within a pre-determined level and the discharged temperature exceeds a given level if the opening of the expansion valve is full. Malfunction of the compressor is thus prevented.

12 Claims, 5 Drawing Sheets

AIR CONDITIONING APPARATUS

BACKGROUND OF THE INVENTION

1. Field of the Invention

The present invention relates to a refrigerating apparatus. More specifically, the invention relates to an air conditioner including a control unit for controlling the operation of a compressor in response to the temperature of the refrigerant in the refrigerating cycle and the ambient temperature.

2. Description of the Prior Art

An air conditioner in which a pulse motor valve (PMV) is provided for maintaining a given superheat (SH) by way of controlling the amount of flow of the refrigerant is known. In the Japanese Patent Disclosure 194259/85, there is shown a refrigerating apparatus which is provided with such PMV and a refrigerant-gas leakage detector for preventing over-heating of the compressor. The detector judges refrigerant-gas leakage during the refrigerating operation and responds to stop the compressor in the condition where PMV is fully opened.

However, the apparatus shown in the Japanese Patent Disclosure 194259/85 has a disadvantage because the detector erroneouesly judges the leakage even when the refrigerant in the refrigerating cycle is properly maintained. The reason for such disadvantage is that the detector responds to the full open condition of the PMV without taking into consideration the ambient temperature. The compressor of the apparatus shown in the disclosure stops its operation even though the ambient temperature is temporaily raised.

SUMMARY OF THE INVENTION

It is an object of the present invention to provide an air conditioner which accurately detects the refrigerant leakage conditions;

It is another object of the present invention to protect a compressor of an air conditioner from the refrigerant leakage in the refrigerating cycle.

To accomplish the above objects, there is provided an air conditioner which comprises

- a refrigerating circuit including a compressor, an expansion valve, a first heat-exchanger disposed outside of the space and a second heat-exchanger disposed inside of the space, the amount of refrigerant in the refrigerating circuit being controlled by the expansion valve,
- a detector for detecting a leakage of refrigerant in said refrigerating circuit, the detector including a first sensor for sensing the load condition of the refrigerating cycle, a second sensor for sensing the temperature of the refrigerant in the refrigerating circuit, and a third sensor for sensing the degree of opening of said expansion valve; and
- a controller responsive to the detector for controlling the operation of the compressor, the controller generating a signal for stopping the operation of the compressor when the output of the first sensor is within a predetermined level and the third sensor detects the expansion valve is fully open.

BRIEF DESCRIPTION OF THE DRAWINGS

The accompanying drawings, which are incorporated in and constitute a part of the specification, illustrate the present preferred embodiment of the invention.

DETAILED DESCRIPTION OF THE PREFERRED EMBODIMENT

Figure 1:
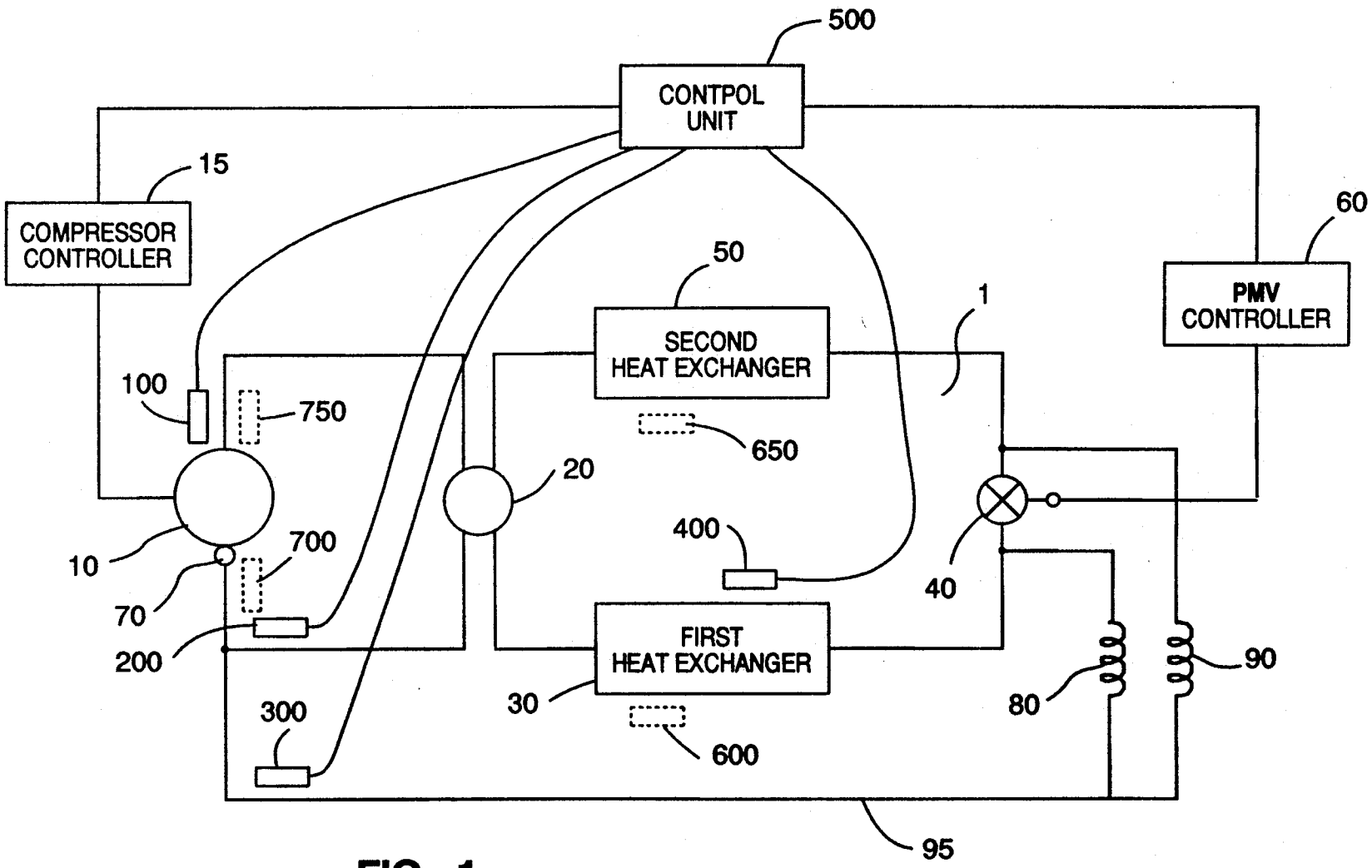
FIG. 1 is a view showing an arrangement of a refrigerating apparatus according to the present invention.

The preferred embodiment of the present invention will now be described in more detail with reference to the accompanying drawings. FIG. 1 shows an arrangement of an air conditioner as an embodiment of the present invention. The first operation mode of the air conditioner will be explained with regard to FIG. 2.

An air conditioner 1 includes a refrigerating circuit with including a compressor 10, four-way valve 20, a first heat-exchanger 30, an expansion valve 40 and a second heat-exchanger 50. Compressor 10 compresses and dicharges the refrigerant medium to four-way valve 20. The discharged refrigerant is supplied to first heat-exchanger 30 when the air conditioner works as a cooling device. First heat-exchanger 30 in this instance becomes a condenser while second heat-exchanger 50 becomes an evaporator. First heat-exchanger 30 is connected to second heat-exchanger 50 via expansion valve 40. Passage or opening of expansion valve 40 is varied by a pulse motor(not shown), and it is specifically called a pulse motor valve (herein-after referred to PMV). First heat-exchanger 30 is installed outside while second heat-exchanger 50 is installed indoors. therefore they are referred to an external heat-exchanger 30 and inner heat-exchanger 50, respectively. Inner heat-exchanger 50 becomes the evaporator when the air conditioner functions as a cooling device while external heat-exchanger 30 becomes the condenser. PMV 40 controls the amount of refrigerant flowing therethrough with a control pulse from a PMV controller 60. An accumulator 70 is connected to the inlet-side of compressor 10. Refrigerant coming from inner heat-exchanger 50 is returned to compressor 10 via four-way valve 20 and accumulator 70. When air conditioner 1 works as a heating device, the refrigerant discharged from compressor 10 flows to four-way valve 20, inner heat-exchanger 50, PMV 40 and external heat-exchanger 30 and it finally returns to compressor 10.

In the vicinity of both the outlet and inlet of compressor 10, there are provided first and second sensors 100,200 for detecting the temperature of the refrigerant. First sensor 100 detects the temperature Td of refrigerant discharged from compressor 10. Second sensor 200 detects the temperature Ts of refrigerant coming into compressor 10. Capillary tubes 80,90 are connected to both ends of PMV 40, which are connected to a common delivery pipe 95 and returns a part of refigerant to compressor 10. A third sensor 300 which detects saturation temperature Te of the refrigerant flowing at the inlet-side of compressor in delively pipe 95 is provided. The passage or opening of PMV 40 is controlled in response to the amount of superheat (SH) of one of heat-exchangers 30,50 whichever functions as the evaporator. Namely, the superheat (SH) 104, which is the differences between temperatures Ts and Te detected by sensors 200, 300, is controlled and kept constant by continuously controlling the degree of opening of PMV 40, as indicated at 106. A control unit 500 which is provided with sensors 100,200,300 is connected to a compressor controller 15 and PMV controller 60. Controller unit 500 is further provided with another sensor for detecting the operating load of the refrigerating cycle. An ambient temperature sensor 400 disposed in the outdoors is the sensor for this purpose. A sensor for detecting temperature of refrigerant in heat-exchanger 30, 50 either forming the evaporator or the condenser can be used as the ambient sensor. Since the pressure ratio of the refrigerant between the inlet-side and outlet-side of compressor 10 indicates the operating load of the air conditioner 1, the arrangement of a first pressure sensor provided at the inlet-side of compressor 10 and a second pressure sensor provided at the outlet-side of compressor 10 can be used for the ambient sensor.

The operation of the embodiment will be explained with flowcharts shown in FIGS. 3 to 5.

Compressor 10 is initiated and four-way valve 20 is set to a proper position according to the selected mode in the conventional manner. In the cooling mode, four-way valve 20 is positioned to supply the refrigerant to external heat-exchanger 30. High-pressure and high-temperature gasous refrigerant is condensed at external heat-exchanger 30 into liquid form. The liquid refrigerant is then supplied to inner heat-exchanger 50 via PMV 40. Part of the refrigerant is returned to compressor 10 through capillary tube 80 and deliverly pipe 95. The refrigerant with its pressure reduced at PMV 40 flows into inner heat-exchanger 50. The refrigerant is evaporated at inner heat-exchanger 50 to become low-pressure and low-temperature gasous refrigerant. Finally the refrigerant is sucked to compressor 10 via accumulator 70 where vapor-liquid separation is done. In the heating mode, the refrigerant flows differently than in cooling mode. Namely, it first runs into inner heat-exchanger 50 via four-way valve 20. The refrigerant is then supplied to external heat-exchanger 30 via PMV 40. Part of the refrigerant in the heating mode is returned to compressor 10 via capillary tube 90.

Figure 2:
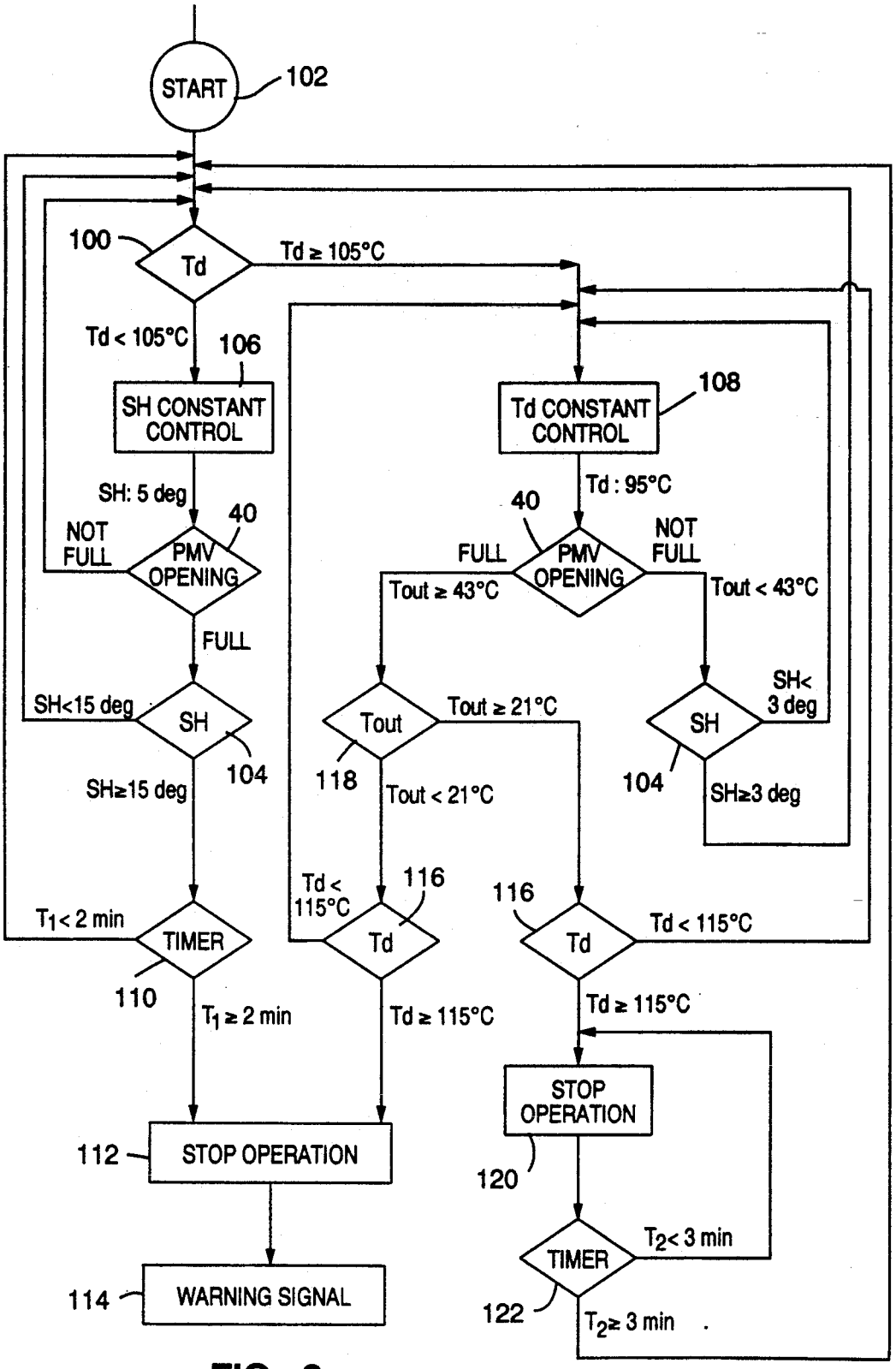
FIG. 2 is a first flowchart showing the first operation mode of the embodiment shown in FIG 1.

FIG. 2 shows a flowchart showing the first operation mode of air conditioner 1. Operation of air conditioner 1 is initiated by an operation signal 102 from outside. In the initial state of the operation, temperature of the refrigerant discharged from compressor 10 is low. The opening of PMV 40 is so adjusted with PMV controller 60, within its limits in which it is not fully open, to maintain the superheat SH at a first given temperature, for instance 5 degrees, if the temperature of the refrigerant Td detected by sensor 100 is below the first set value, for instance 105° C. This SH constant control 106 is continuously performed under a low load state.

The opening of PMV 40 is set not to be fully opened below a pre-set external or ambient temperature, for instance below 43° C. when air conditioner 1 works in the cooling mode and below 21° C. when it works in the heating mode.

When the air conditioning operation is continued while performing SH constant control and sensor 100 detects temperature Td exceeding the first set value 105° C. (the load of compressor becomes in high load state), the opening of PMV 40 is then so adjusted with PMV controller 60, within its limits in which it is not fully open, that the temperature Td is keep within a second set value such as 95° C. Thus the Td constant control is peformed, however if superheat SH 104 is over a second given value, for instance 3 degrees, The Td constant control 108 is stopped and control the state is returned to the SH constant control 106.

When the amount of the refrigerant in the refrigerant cycle is reduced and a state of insufficiency occurs for some reason, control unit 500 operates as follows. Namely, when performing the SH constant control in a low load state, PMV 40 passage is controlled to gradually open to lower the superheat SH to the first given temperature (5 degrees) since the superheat SH increases due to the lack of the refrigerant. Eventually, PMV 40 becomes fully open, however superheat SH continues to increase. The degree of opening of PMV 40 is detected by counting pulses sent to PMV 40 from PMV controller 60. When superheat SH raises and exceeds a third given temperature such as 15 degrees and this state is continued and unchanged for a first set time such as 2 minutes as indicated at the timer block 110, the operation of compressor 10 is stopped by compressor controller 15 as indicated by block 112. At the same time, control unit 500 generates a warning signal 114 to indicate that an abnormality has occurred. When superheat SH exceeds the third given temperature, but this state is interrupted or changed within 2 minutes the SH constant control operation is continued.

When superheat SH is within the third given temperature (15 degrees) with full open position of PMV 40, control unit 500 judges that the amount of refrigerant in the refrigrating cycle is in allowable limits and it continues the SH constant operation.

When performing Td constant operation in a high load state, PMV 40 gradually opens its passage so as to keep the refrigerant temperature Td 116 below the second set value (95° C.) since the refrigerant temperature Td is raised due to lack of the refrigerant. Eventually, PMV 40 becomes fully open in the same way as with the SH constant control in low load state. Thereafter, the refrigerant temperature Td continues to raise.

When sensor 400 detects an outside temperature Tout 118 below a pre-set value, such as 43° C. during the cooling operation and below 21° C. during the heating operation with fully opened PMV 40, and the refrigerant temperature Td is greater than a third set value, such as 115° C., compressor controller 15 by responding to control unit 500 stops the operation of compressor 10 as indicated at 120. At the same time, control unit 500 generates signals to indicate that an abnormality has occurred. When the external temperature Tout is less than the set value(43° C.) with fully open PMV 40, and the temperature Td is less than the third set value (115° C.), the Td constant control is continued since the amount of the refrigerant in the refrigerating cycle is regarded within the allowable limits.

In the Td constant control operation, when sensor 400 detects Tout exceeding the preset value (43° C.) with the fully opened PMV 40 and discharge temperature Td is greater than the third set value (115° C.), control unit 500 judges the over-load condition and generates and sends the signal to compressor controller 15 to stop the operation of compressor 10. Then after a second set time as indicated by 122, for instance 3 minutes, has elapsed in the stopped condition, compressor 10 is re-started. Control unit 500 at this state judges that the amount of refrigerant in the refrigerating cycle is sufficient to re-start compressor 10 since temperature Te exceeds the third set value (115° C.), which is an indication of the over-load condition, was caused by the raising of the external temperature Tout.

As can be understood from the above-described first mode operation of the embodiment of the present invention, the lack of refrigerant in the refrigerating cycle is detected by various aspects, such as the superheat SH, degree of opening of PMV 40, temperature Td, temperature Te and temperature Tout. In case the amount of the refrigerant in the refrigerating cycle is reduced for some reason and causes insufficiency of refrigerating while performing SH constant control in low load condition control unit 500 indicates the lack of refrigerant by stopping the operation of compressor 10 when superheat SH becomes more than the specific amount in the state in which PMV 40 is fully open. Preferably, compressor 10 is to be stopped after a specific time has elapsed since adjusting the opening of PMV is not effected instantly and some time is required. Alternatively, in case of performing the Td constant control in high load condition, when both refrigerant temperature Td and external temperature Tout become their specific temperatures with the condition in that PMV 40 is fully open, control unit 500 judges that the lack of the refrigerant has occurred and stops compressor 10 with compressor controller 15. In this way, air conditioner 1 according to the present invention detects the lack of refrigerant in the refrigerating cycle at an early stage by checking the temperatures in various parts of air conditioner 1 so that malfunction of compressor 10 will not caused.

Figure 3:
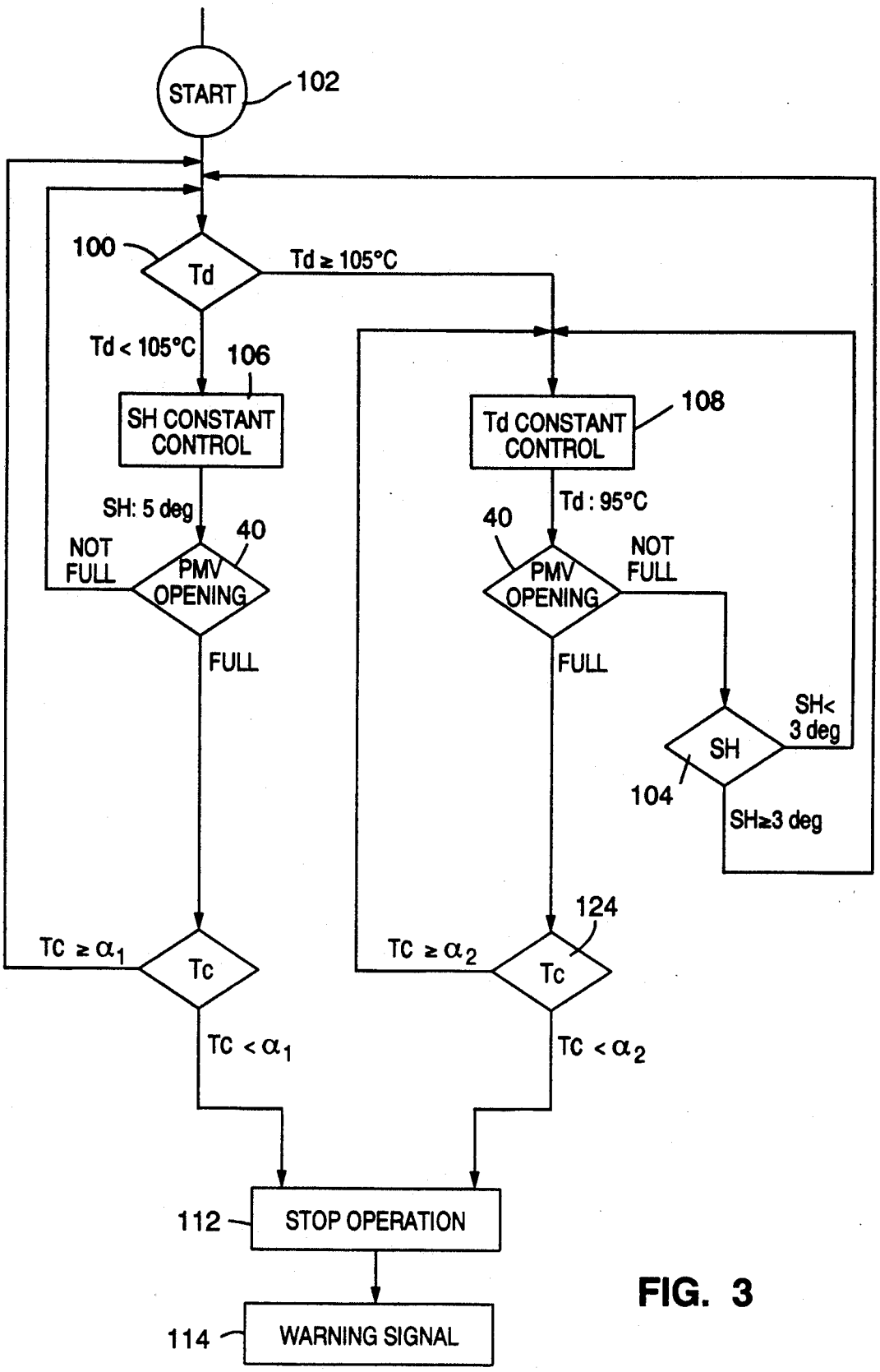
FIG. 3 is a second flowchart showing the second operation mode of the embodiment shown in FIG. 1.

FIG. 3 is a flowchart showing the control operation mode of air conditioner 1. In this mode, SH constant control 106 in the low load condition and Td constant control 108 in high load control are performed in the same way as in the first operation mode described hereinbefore. However sensors 600, 650 disposed at heat exchangers 30, 50 are used instead of sensor 400 for detecting the condition of the refrigerating cycle. These Sensors 600,650 detect condensing temperature Tc 124 of refrigerant flowing in heat-exchangers 30,50 whichever functions as a condenser.

When the amount of the refrigerant in the refrigerating cycle is insufficient, PMV 40 eventually becomes full open as described above. In this state, if condensing temperature Tc is below the specific temperature, control unit 500 indicates the lack of refrigerant in the refrigerating cycle and generates signals to stop operation of compressor 10 with compressor controller 15. A specific condensing temperature Tc in the cooling mode and the same in the heating mode are properly set for performing the controlling operation.

Figure 4:
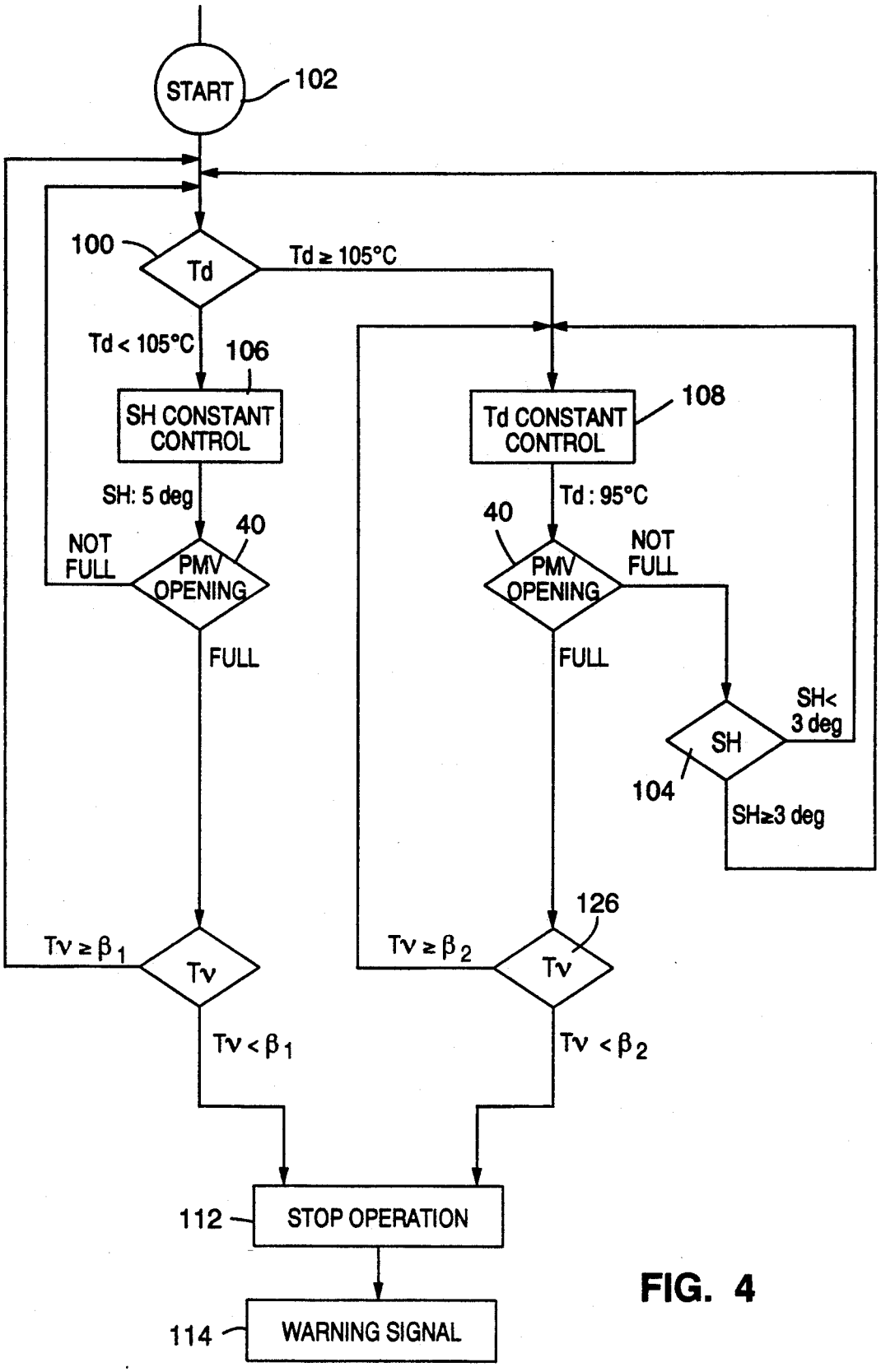
FIG. 4 is a third flowchart showing the third operation mode of the embodiment shown in FIG. 1.

FIG. 4 is a flowchart showing the third control operation mode of the air conditioner 1. As can be understood from FIG. 4, this operation mode is quite similar to that shown in FIG. 3. Namely, instead of detecting the condensing refrigerant temperature Tc of heat-exchangers 30,50, sensors 600,650 detect evaporating refrigerant temperature Tv 126, representing the condition of a refrigerating cycle.

Figure 5:
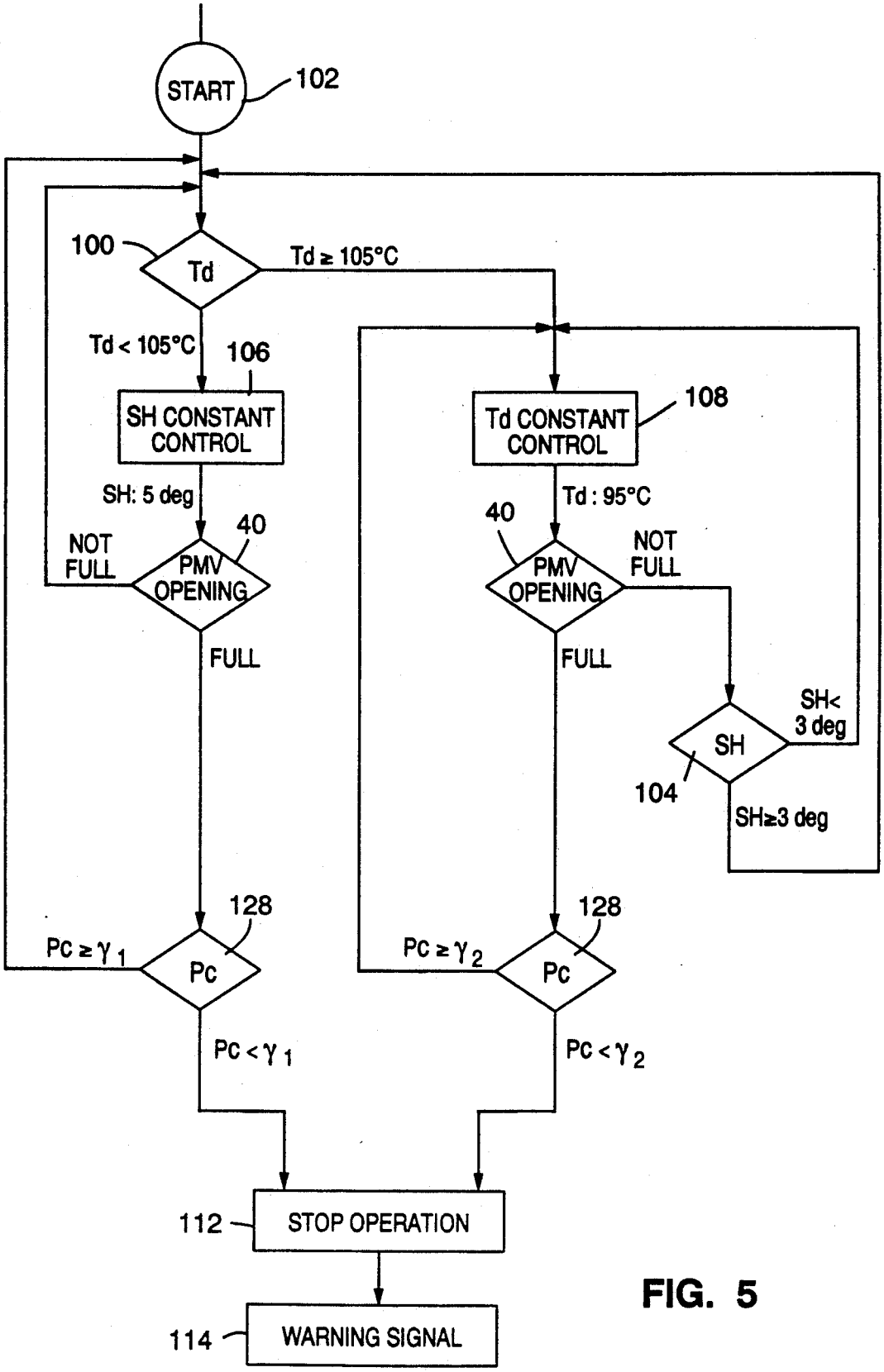
FIG. 5 is a fourth flowchart showing the fourth operation mode of the embodiment shown in FIG. 1.

FIG. 5 is a flowchart showing the fourth control operation mode of air conditioner 1. the only difference between the operation modes shown in FIG. 3 (or FIG. 4) and in FIG. 5 is that the condition of the refrigerating cycle is detected by the pressure ratio 128 between the suction port and the feeding port of compressor 10. The pressure ratio is obtained by detecting each pressure by sensors 700,750 provided at the suction port and feeding port of compressor 10. It is apparent that the fourth control operation mode is performed and effected as in the same way as in the modes described above.

The air conditioner according to the present invention detects the lack of refrigerant in refrigerating cycle at an early stage by checking the temperatures in various parts of the air conditioner so that a malfunction of the compressor will not be caused.

The present invention has been described with respect to a specific embodiment. However, other embodiments based on the principles of the present invention should be obvious to those of ordinary skill in the art. Such embodiments are intended to be covered by the claims.

What is claimed is:

1. A refrigerating apparatus for air conditioning a given space comprising:

a refrigerating circuit including a compressor, an expansion valve, a first heat-exchanger disposed outside of said space and a second heat-exchanger disposed inside of said space, the flow rate of refrigerant in said refrigerating circuit being controlled by the expansion valve, a detector means for detecting a leakage of refrigerant in said refrigerating circuit, said detector means including a first sensor for sensing the load condition of the refrigerating cycle, a second sensor for sensing the temperature of the refrigerant in the refrigerating circuit, and a third sensor for sensing the degree of opening of said expansion valve; and control means responsive to said detector means for controlling the operation of said compressor, said control means generating a signal for stopping the operation of said compressor when the output of said first sensor is below a first predetermined level and said third sensor detects of said expansion valve is fully open.

2. A refrigerant apparatus according to claim 1, wherein said first sensor includes a temperature sensor provided at said outside space for detecting the ambient temperature of the apparatus, said signal being generated when the ambient temperature is lower than a predetermined temperature.

3. A refrigerant apparatus according to claim 1, wherein said first sensor includes a temperature sensor provided in the vicinity of said first heat-exchanger performing as a condensor for the refrigerant whereby said temperature sensor detects the condensing refrigerant temperature of said first heat-exchanger when the apparatus works in the cooling mode.

4. A refrigerant apparatus according to claim 1, wherein said first sensor includes a temperature sensor provided in the vicinity of said first heat-exchanger performing as an evaporator for the refrigerant whereby said temperature sensor detects the evaporating refrigerant temperature of said first heat-exchanger when the apparatus works in the heating mode.

5. A refrigerant apparatus according to claim 1, wherein said first sensor includes pressure sensors provided at the inlet-side of said compressor and the outlet-side of said compressor for detecting the pressure ratio of the refrigerant.

6. A refrigerant apparatus according to claim 1, wherein said control means includes means for temporarily stopping the operation of said compressor, timer means for restarting the operation of said compressor when the output of said first sensor is above said predetermined level and said third sensor detects the full open setting of said expansion valve; and means for re-starting said compressor after a given time.

7. An air conditioning apparatus for air conditioning a given space comprising:

a refrigerating circuit including a compressor, an expansion valve, a first heat-exchanger disposed outside of said space and a second heat-exchanger disposed inside of said space, the flow rate of refrigerant in said refrigerating circuit being controlled by the expansion valve, a detector means for detecting a leakage of refrigerant in said refrigerating circuit, said detector means including (a) first detector means for detecting the load condition of the refrigerating cycle, said first detector means including a first sensor for measuring the load condition, (b) second detector means for sensing the temperature of the refrigerant in the refrigerating circuit and (c) third detector means for sensing the degree of opening of said expansion valve, said second detector means comprising a first sensor for sensing the discharged temperature of the refrigerant fed from said compressor, a third sensor for sensing the temperature of the refrigerant entering said compressor and a fourth sensor for sensing the saturation temperature of the refrigerant in said refrigerating circuit; and control means responsive to said detector means for controlling the operation of said compressor, said control means generating a signal for stopping the operation of said compressor when the load condition sensed by said first sensor is below a first predetermined level and the temperature sensed by said second sensor exceeds a second predetermined level and said third sensor detects the full open setting condition of said expansion valve.

8. An air conditioning apparatus according to claim 7 wherein said first detector means includes a temperature sensor provided in the vicinity of said first heat-exchanger performing as a condensor for the refrigerant whereby said temperature sensor detects the condensing refrigerant temperature of said first heat-exchanger when the apparatus works in the cooling mode.

9. An air conditioning apparatus according to claim 7, wherein said first detector means includes a temperature sensor provided in the vicinity of said first heat-exchanger performing as an evaporator for the refrigerant whereby said temperature sensor detects the evaporating refrigerant temperature of said first heat-exchanger when the apparatus works in the heating mode.

10. An air conditioning apparatus according to claim 7, wherein said first detector means includes pressure sensors provided at the inlet-side of said compressor and the outlet-side of said compressor for detecting pressure ratio of the refrigerant.

11. An air conditioning apparatus for air conditioning a given space comprising:

a refrigerating circuit including a compressor, an expansion valve, a first heat-exchanger disposed outside of said space and a second heat-exchanger disposed inside of said space, the flow rate of refrigerant in said refrigerating circuit being controlled by the expansion valve, a detector means for detecting a leakage of refrigerant in said refrigerating circuit, said detector means including (a) first detector means for detecting the load condition of the refrigerating cycle, (b) second detector means for sensing the temperature of the refrigerant in the refrigerating circuit and (c) third detector means for sensing the degree of opening of said expansion valve, said first detector means comprising a first sensor for sensing the temperature of the outside space, said second detector means comprising a second sensor for sensing the discharged temperature of the refrigerant fed from said compressor, a third sensor for sensing the temperature of the refrigerant taking into said compressor and a fourth sensor for sensing saturation temperature of the refrigerant in said refrigerating circuit; and control means responsive to said detector means for controlling the operation of said compressor, said control means generating a signal for stopping the operation of said compressor when the temperature sensed by said first sensor is below a first predetermined level and the temperature sensed by said second sensor exceeds a second predetermined level and said third sensor detects the full open setting condition of said expansion valve.

12. An air conditioning apparatus according to claim 11, wherein said control means includes means for temporarily stopping the operation of said compressor when the temperature detected by said first sensor is above said first predetermined level and the temperature sensed by said second sensor exceeds said second predetermined level where said third detector means detects the full open setting condition of said expansion valve; and means for re-starting said compressor after a given time.

* * * * *